US010969737B2

(12) United States Patent
Haruta et al.

(10) Patent No.: US 10,969,737 B2
(45) Date of Patent: Apr. 6, 2021

(54) IMAGE FORMING APPARATUS AND METHOD FOR ENSURING ADEQUATE TORQUE OF DEVELOPMENT MOTOR AND SUPPRESSING REDUCTION IN PRINTING SPEED IN LOW-TEMPERATURE ENVIRONMENT

(71) Applicant: BROTHER KOGYO KABUSHIKI KAISHA, Nagoya (JP)

(72) Inventors: Kotaro Haruta, Yokkaichi (JP); Masahito Saeki, Nagoya (JP); Shintaro Sakaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/580,742

(22) Filed: Sep. 24, 2019

(65) Prior Publication Data

US 2020/0301358 A1 Sep. 24, 2020

(30) Foreign Application Priority Data

Mar. 19, 2019 (JP) ..... JP2019-051078

(51) Int. Cl.
*G03G 15/00* (2006.01)
*G03G 21/20* (2006.01)

(52) U.S. Cl.
CPC ..... *G03G 21/20* (2013.01); *G03G 15/757* (2013.01)

(58) Field of Classification Search
CPC ..... G03G 21/20; G03G 15/757
See application file for complete search history.

(56) References Cited

U.S. PATENT DOCUMENTS 6,795,671 B2 * 9/2004 Matsuoka ..... G03G 15/0194 399/223
2008/0056742 A1 3/2008 Hattori et al.
2008/0285985 A1 * 11/2008 Park ..... G03G 15/0808 399/27
2016/0124345 A1 * 5/2016 Ishikawa ..... F16H 1/08 399/265

FOREIGN PATENT DOCUMENTS

JP 2008-058513 A 3/2008
JP 2012-189699 A 10/2012

* cited by examiner

*Primary Examiner* — Clayton E. LaBalle
*Assistant Examiner* — Michael A Harrison
(74) *Attorney, Agent, or Firm* — Merchant & Gould P.C.

(57) ABSTRACT

An image forming apparatus includes a controller configured to, before driving a development motor, obtain a temperature inside a housing from a temperature sensor, determine whether the obtained temperature inside the housing is equal to or lower than a particular temperature, when determining that the temperature inside the housing is higher than the particular temperature, execute a full-speed mode to control the development motor to rotate at a first target speed and control a process motor to rotate at a second target speed, and when determining that the temperature inside the housing is equal to or lower than the particular temperature, execute a low-temperature mode to control the development motor to rotate at a third target speed lower than the first target speed and control the process motor to rotate at the second target speed that is the same as in the full-speed mode.

17 Claims, 8 Drawing Sheets

IMAGE FORMING APPARATUS AND METHOD FOR ENSURING ADEQUATE TORQUE OF DEVELOPMENT MOTOR AND SUPPRESSING REDUCTION IN PRINTING SPEED IN LOW-TEMPERATURE ENVIRONMENT

CROSS-REFERENCE TO RELATED APPLICATION

This application claims priority under 35 U.S.C. § 119 from Japanese Patent Application No. 2019-051078 filed on Mar. 19, 2019. The entire subject matters of the applications are incorporated herein by reference.

BACKGROUND

Technical Field

Aspects of the present disclosure are related to an image forming apparatus and a method for ensuring an adequate torque of a development motor of the apparatus and suppressing reduction in printing speed in a low-temperature environment.

Related Art

Heretofore, it has been known that the use of an image forming apparatus in a low-temperature environment causes an increased viscosity of grease for a motor of the apparatus, thereby increasing a load for driving the motor. Hence, it is desired to ensure an adequate torque of the motor in such a low-temperature environment.

For instance, an image forming apparatus has been known that has a full-speed mode and a half-speed mode as settable modes for driving a motor of the apparatus. In the full-speed mode, a controller of the apparatus drives the motor at full rotational speed. In the half-speed mode, the controller drives the motor at half rotational speed. The controller may drive the motor in the half-speed mode in the low-temperature environment.

SUMMARY

Even when used in the low-temperature environment, the known image forming apparatus may ensure an adequate torque of the motor, since the motor is driven in the half-speed mode in the low-temperature environment. In this case, however, a printing speed is lowered.

Aspects of the present disclosure are advantageous to provide one or more improved techniques for an image forming apparatus that make it possible to ensure an adequate torque of a development motor of the apparatus and suppress reduction in printing speed even when a temperature inside a housing of the apparatus is equal to or less than a particular temperature.

According to aspects of the present disclosure, an image forming apparatus is provided, which includes a housing, a photoconductive drum, a development roller movable between a contact position where the development roller contacts the photoconductive drum and a separate position where the development roller is separated from the photoconductive drum, the development roller being configured to supply toner to the photoconductive drum in the contact position, a switching mechanism configured to move the development roller between the contact position and the separate position, a conveyance belt configured to convey a sheet in a state where the sheet is nipped between the conveyance belt and the photoconductive drum, a development motor configured to drive the development roller and the switching mechanism, a process motor configured to drive the photoconductive drum and the conveyance belt, a temperature sensor configured to measure a temperature inside the housing, and a controller. The controller is configured to, before driving the development motor, obtain the temperature inside the housing from the temperature sensor, determine whether the obtained temperature inside the housing is equal to or lower than a particular temperature, when determining that the obtained temperature inside the housing is higher than the particular temperature, execute a full-speed mode to control the development motor to rotate at a first target speed and control the process motor to rotate at a second target speed, and when determining that the obtained temperature inside the housing is equal to or lower than the particular temperature, execute a low-temperature mode to control the development motor to rotate at a third target speed lower than the first target speed and control the process motor to rotate at the second target speed that is the same as in the full-speed mode.

According to aspects of the present disclosure, further provided is a image forming apparatus that includes a housing, a photoconductive drum, a development roller movable between a contact position where the development roller contacts the photoconductive drum and a separate position where the development roller is separated from the photoconductive drum, the development roller being configured to supply toner to the photoconductive drum in the contact position, a switching mechanism configured to move the development roller between the contact position and the separate position, a conveyance belt configured to convey a sheet in a state where the sheet is nipped between the conveyance belt and the photoconductive drum, a development motor configured to drive the development roller and the switching mechanism, a process motor configured to drive the photoconductive drum and the conveyance belt, a temperature sensor configured to measure a temperature inside the housing, and a controller. The controller is configured to, before obtaining the temperature inside the housing from the temperature sensor, execute a full-speed mode to control the development motor to rotate at a first target speed and control the process motor to rotate at a second target speed, determine whether the development motor is rotating at the first target speed, when determining that the development motor is not rotating at the first target speed, terminate the full-speed mode and obtain the temperature inside the housing from the temperature sensor, and when determining that the obtained temperature inside the housing is equal to or lower than a particular temperature, execute a low-temperature mode to control the development motor to rotate at a third target speed lower than the first target speed and control the process motor to rotate at the second target speed that is the same as in the full-speed mode.

According to aspects of the present disclosure, further provided is a method implementable on a controller of an image forming apparatus. The image forming apparatus includes a housing, a photoconductive drum, a development roller movable between a contact position where the development roller contacts the photoconductive drum and a separate position where the development roller is separated from the photoconductive drum, the development roller being configured to supply toner to the photoconductive drum in the contact position, a switching mechanism configured to move the development roller between the contact position and the separate position, a conveyance belt configured to convey a sheet in a state where the sheet is nipped between the conveyance belt and the photoconductive drum, a development motor configured to drive the development roller and the switching mechanism, and a process motor configured to drive the photoconductive drum and the conveyance belt. The method includes obtaining, before driving the development motor, a temperature inside the housing, determining whether the obtained temperature inside the housing is equal to or lower than a particular temperature, when determining that the obtained temperature inside the housing is higher than the particular temperature, executing a full-speed mode to control the development motor to rotate at a first target speed and control the process motor to rotate at a second target speed, and when determining that the obtained temperature inside the housing is equal to or lower than the particular temperature, executing a low-temperature mode to control the development motor to rotate at a third target speed lower than the first target speed and control the process motor to rotate at the second target speed that is the same as in the full-speed mode.

BRIEF DESCRIPTION OF THE ACCOMPANYING DRAWINGS

FIG. 1 schematically shows a configuration of an image forming apparatus in a first illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

First Illustrative Embodiment

1. General Overview of Image Forming Apparatus

Figure 1:
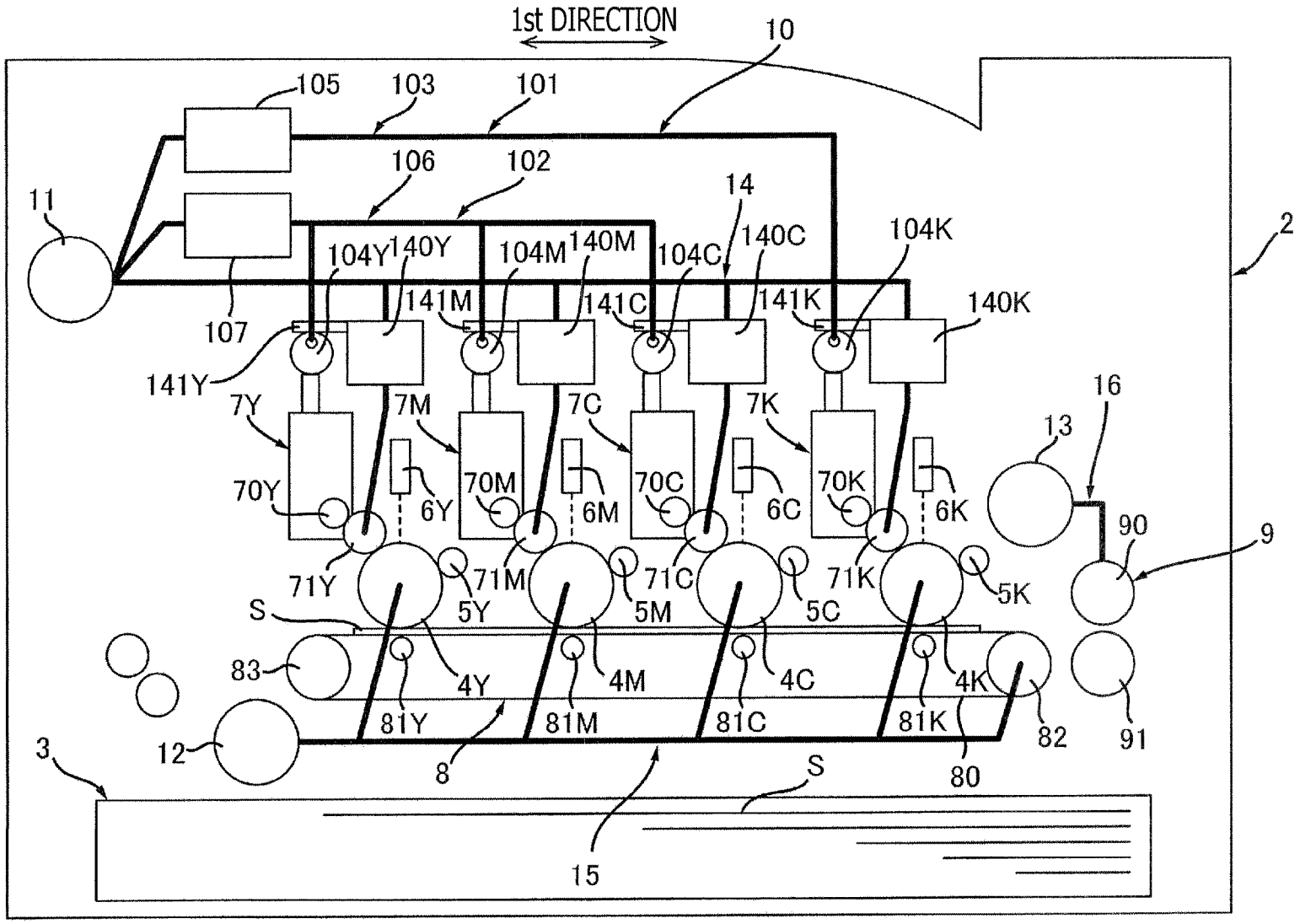

The following provides a general overview of an image forming apparatus 1 in a first illustrative embodiment according aspects of the present disclosure, with reference to FIG. 1.

As shown in FIG. 1, the image forming apparatus 1 includes a housing 2, a feed tray 3, four photoconductive drums 4Y, 4M, 4C, and 4K, four chargers 5Y, 5M, 5C, and 5K, four exposure devices 6Y, 6M, 6C, and 6K, four development devices 7Y, 7M, 7C, and 7K, a belt unit 8, and a fuser 9.

1.1 Housing

The housing 2 is configured to accommodate the feed tray 3, the four photoconductive drums 4Y, 4M, 4C, and 4K, the four chargers 5Y, 5M, 5C, and 5K, the four exposure devices 6Y, 6M, 6C, and 6K, the four development devices 7Y, 7M, 7C, and 7K, the belt unit 8, and the fuser 9.

1.2 Feed Tray

The feed tray 3 is configured to hold one or more sheets S placed thereon. The one or more sheets S placed on the feed tray 3 may be fed to the photoconductive drum 4Y. Examples of the sheets S may include, but are not limited to, printing paper.

1.3 Photoconductive Drums

The four photoconductive drums 4Y, 4M, 4C, and 4K are arranged along a first direction. Each of the photoconductive drums 4Y, 4M, 4C, and 4K is rotatable around an axis extending along a second direction. The second direction intersects the first direction. Preferably, the second direction may be perpendicular to the first direction. Each of the four photoconductive drums 4Y, 4M, 4C, and 4K is formed in a cylindrical shape extending along the second direction.

1.4 Chargers

The charger 5Y is configured to charge a surface of the photoconductive drum 4Y. The charger 5M is configured to charge a surface of the photoconductive drum 4M. The charger 5C is configured to charge a surface of the photoconductive drum 4C. The charger 5K is configured to charge a surface of the photoconductive drum 4K. Specifically, each of the four chargers 5Y, 5M, 5C, and 5K is a charging roller. Each of the four chargers 5Y, 5M, 5C, and 5K may be a scorotron charger.

1.5 Exposure Devices

The exposure device 6Y is configured to expose the charged surface of the photoconductive drum 4Y, thereby forming an electrostatic latent image on the surface of the photoconductive drum 4Y. The exposure device 6M is configured to expose the charged surface of the photoconductive drum 4M, thereby forming an electrostatic latent image on the surface of the photoconductive drum 4M. The exposure device 6C is configured to expose the charged surface of the photoconductive drum 4C, thereby forming an electrostatic latent image on the surface of the photoconductive drum 4C. The exposure device 6K is configured to expose the charged surface of the photoconductive drum 4K, thereby forming an electrostatic latent image on the surface of the photoconductive drum 4K. Specifically, each of the four exposure devices 6Y, 6M, 6C, and 6K is an LED unit having an LED array. The image forming apparatus 1 may include a single exposure device configured to expose all the surfaces of the four photoconductive drums 4Y, 4M, 4C, and 4K. In this case, the single exposure device may be a laser scanning unit.

1.6 Development Devices

The development device 7Y is configured to store toner. The development device 7Y is attachable to the image forming device 1. The development device 7Y includes a supply roller 70Y and a development roller 71Y.

The supply roller 70Y is rotatable around an axis extending along the second direction. The supply roller 70Y is formed in a cylindrical shape extending along the second direction. The supply roller 70Y is housed inside the development device 7Y.

The development roller 71Y is rotatable around an axis extending along the second direction. The development roller 71Y is formed in a cylindrical shape extending along the second direction. A part of the development roller 71Y is housed in the development device 7Y. Apart of the development roller 71Y is in contact with the supply roller 70Y. Thereby, the supply roller 70Y supplies the toner stored in the development device 7Y to a circumferential surface of the development roller 71Y. In a state where the development device 7Y is attached to the image forming apparatus 1, the development roller 71Y contacts the circumferential surface of the photoconductive drum 4Y. Thereby, the development roller 71Y supplies the toner to the circumferential surface of the photoconductive drum 4. Thus, the electrostatic latent image on the circumferential surface of the photoconductive drum 4 is developed, and a toner image is formed on the circumferential surface of the photoconductive drum 4.

Each of the development devices 7M, 7C, and 7K has substantially the same configuration as the development device 7Y. Specifically, the development device 7M includes a supply roller 70M and a development roller 71M. The supply roller 70M supplies the toner stored in the development device 7M to the circumferential surface of the development roller 71M. The development roller 71M supplies the toner to the circumferential surface of the photoconductive drum 4M. Further, the development device 7C includes a supply roller 70C and a development roller 71C. The supply roller 7C supplies the toner stored in the development device 7C to the circumferential surface of the development roller 71C. The development roller 71C supplies the toner to the circumferential surface of the photoconductive drum 4C. Further, the development device 7K includes a supply roller 70K and a development roller 71K. The supply roller 7K supplies the toner stored in the development device 7K to the circumferential surface of the development roller 71K. The development roller 71K supplies the toner to the circumferential surface of the photoconductive drum 4K. Namely, the image forming apparatus 1 includes the four development rollers 71Y, 71M, 71C, and 71K.

As will be described in detail later, the development device 7Y, as attached to the image forming apparatus 1, is movable between a contact position and a separate position (see FIG. 6). When the development device 7Y is in the contact position, the development roller 71Y contacts the photoconductive drum 4Y. When the development device 7Y is in the separate position, the development roller 71Y is separated from the photoconductive drum 4Y. Likewise, the development device 7M, as attached to the image forming apparatus 1, is movable between a contact position where the development roller 71M contacts the photoconductive drum 4M and a separate position (see FIG. 6) where the development roller 71M is separated from the photoconductive drum 4M. The development device 7C, as attached to the image forming apparatus 1, is movable between a contact position where the development roller 71C contacts the photoconductive drum 4C and a separate position (see FIG. 6) where the development roller 71C is separated from the photoconductive drum 4C. The development device 7K, as attached to the image forming apparatus 1, is movable between a contact position where the development roller 71K contacts the photoconductive drum 4K and a separate position (see FIG. 6) where the development roller 71K is separated from the photoconductive drum 4K. In other words, each of the development rollers 71Y, 71M, 71C, and 71K is movable between a contact position where each development roller contacts the corresponding photoconductive drum and a separate position (see FIG. 6) where each development roller is separated from the corresponding photoconductive drum.

1.7 Belt Unit

The belt unit 8 includes a first roller 82, a second roller 83, a conveyance belt 80, and four transfer rollers 81Y, 81M, 81C, and 81K. Namely, the image forming apparatus 1 includes the conveyance belt 80.

The first roller 82 is rotatable around an axis extending along the second direction. The second roller 83 is spaced apart from the first roller 82 in the first direction. The second roller 83 is opposed to the first roller 82 across the fuser 9 in the first direction. The second roller 83 is rotatable around an axis extending along the second direction.

The conveyance belt 80 is supported by the first roller 82 and the second roller 83. In response to a driving force being applied to the first roller 82, the conveyance belt 80 starts a circular movement. The conveyance belt 80 conveys a sheet S fed from the feed tray 3 in a state where the sheet S is nipped between the conveyance belt 80 and at least one of the four photoconductive drums 4Y, 4M, 4C, and 4K. The conveyance belt 80 conveys the sheet toward the fuser 9 in such a manner that the sheet S sequentially comes into contact with each of the four photoconductive drums 4Y, 4M, 4C, and 4K.

The four transfer rollers 81Y, 81M, 81C, and 81K are disposed in a space surrounded by the conveyance belt 80. The transfer roller 81Y is configured to transfer the toner image formed on the surface of the photoconductive drum 4Y onto the sheet S being conveyed by the conveyance belt 80. The transfer roller 81M is configured to transfer the toner image formed on the surface of the photoconductive drum 4M onto the sheet S being conveyed by the conveyance belt 80. The transfer roller 81C is configured to transfer the toner image formed on the surface of the photoconductive drum 4C onto the sheet S being conveyed by the conveyance belt 80. The transfer roller 81K is configured to transfer the toner image formed on the surface of the photoconductive drum 4K onto the sheet S being conveyed by the conveyance belt 80.

1.8 Fuser

The fuser 9 is configured to heat and press the sheet S with the toner image transferred thereon, thereby fixing the toner image onto the sheet S. After passing through the fuser 9, the sheet S is discharged onto the sheet S. The fuser 9 includes a heating roller 90 and a pressing roller 91. The heating roller 90 is configured to heat the sheet S with the toner image transferred thereon. The heating roller 90 is rotatable around an axis extending along the second direction. The pressing roller 91 is configured to press the sheet with the toner image transferred thereon, by nipping the sheet S with the heating roller 90. The pressing roller 91 is rotatable around an axis extending along the second direction.

2. Details of Image Forming Apparatus

Subsequently, the image forming apparatus 1 will be described in detail with reference to FIGS. 1 and 2.

As shown in FIG. 1, the image forming apparatus 1 includes a development roller 11, a process motor 12, a fuser motor 13, a switching mechanism 10, a first gear train 14, four levers 141Y, 141M, 141C, and 141K, a second gear train 15, and a third gear train 16.

The development roller 11 is configured to drive the four development rollers 71Y, 71M, 71C, and 71K, and the switching mechanism 10. More specifically, the development roller 11 is configured to drive the four development rollers 71Y, 71M, 71C, and 71K, and four contact-separation members 104Y, 104M, 104C, and 104K included in the switching mechanism 10.

The process motor 12 is configured to drive the four photoconductive drums 4Y, 4M, 4C, and 4K, and the conveyance belt 80. More specifically, the process motor 12 is configured to drive the four photoconductive drums 4Y, 4M, 4C, and 4K, and the first roller 82.

The fuser motor 13 is configured to drive the fuser 9. More specifically, the fuser motor 13 is configured to drive the heating roller 90.

The switching mechanism 10 is configured to move each of the four development devices 7Y, 7M, 7C, and 7K between the contact position and the separate position for each development device. Namely, the switching mechanism 10 is configured to move each of the four development rollers 71Y, 71M, 71C, and 71K between the contact position and the separate position for each development roller. The switching mechanism 10 includes a first switching mechanism 101 and a second switching mechanism 102.

The first switching mechanism 101 is configured to move the development roller 71K between the contact position and the separate position for the development roller 71K. The first switching mechanism 101 includes the contact-separation member 104K and a fourth gear train 103.

The contact-separation member 104K is movable between a first position and a second position (see FIG. 6) therefor. In the first illustrative embodiment, the contact-separation member 104K is rotatable around an axis extending along the second direction, between the first position and the second position for the contact-separation member 104K. The contact-separation member 104K is eccentrically rotatable. The contact-separation member 104K is formed in a circular shape in a view along the second direction. A rotational center of the contact-separation member 104K is positioned off a center of the circular shape of the contact-separation member 104K.

When the contact-separation member 104K is in the first position, the contact-separation member 104K causes the development roller 71K to be in the contact position. In the first illustrative embodiment, the development device 7K, as attached to the image forming apparatus 1, is pressed in such a direction that the development roller 71K becomes farther away from the photoconductive drum 4K, by a pressing member (not shown). Then, when the contact-separation member 104K is in the first position, the contact-separation member 104K presses the development device 7K toward the photoconductive drum 4K against a pressing force from the pressing member (not shown). Thereby, the development roller 71K is put in the contact position.

Further, when the contact-separation member 104K is in the second position (see FIG. 6), the contact-separation member 104K causes the development roller 71K to be in the separate position. In the first illustrative embodiment, when the contact-separation member 104K moves from the first position to the second position in the state where the development device 7K is attached to the image forming apparatus 1, the contact-separation member 104K allows the development device 7K to move in such a direction as to become farther away from the photoconductive drum 4K by the pressing force from the pressing member (not shown). Thereby, the development roller 71K is separated from the photoconductive drum 4K and moves from the contact position to the separate position.

The fourth gear train 103 is configured to transmit a driving force from the development motor 11 to the contact-separation member 104K. The fourth gear train 103 includes a plurality of gears, though a specific configuration thereof is not shown in FIG. 1 for the sake of explanatory simplicity. Each of the gears included in the fourth gear train 103 is coated with grease. The fourth gear train 103 includes a first electromagnetic clutch 105. The first electromagnetic clutch 105 is switchable between an ON state and an OFF state. When the first electromagnetic clutch 105 is in the ON state, the driving force from the development motor 11 is transmitted to the contact-separation member 104K via the fourth gear train 103. When the first electromagnetic clutch 105 is in the OFF state, the driving force from the development motor 11 is shut off by the first electromagnetic clutch 105 and is not transmitted to the contact-separation member 104K.

The second switching mechanism 102 is configured to move the three development rollers 71Y, 71M, and 71C between the respective contact positions and the respective separate positions. The second switching mechanism 102 includes three contact-separation members 104Y, 104M, and 104C, and a fifth gear train 106.

Each of the three contact-separation members 104Y, 104M, and 104C has substantially the same configuration as the contact-separation member 104K and therefore may be explained in the same manner as the contact-separation member 104K. Further, each of the three development devices 7Y, 7M, and 7C, as attached to the image forming apparatus 1, is pressed by a pressing member (not shown) in substantially the same manner as the development device 7K. Namely, the contact-separation member 104Y is movable between a first position to cause the development roller 71Y to be in the contact position and a second position to cause the development roller 71Y to be in the separate position. The contact-separation member 104M is movable between a first position to cause the development roller 71M to be in the contact position and a second position to cause the development roller 71M to be in the separate position. The contact-separation member 104C is movable between a first position to cause the development roller 71C to be in the contact position and a second position to cause the development roller 71C to be in the separate position.

The fifth gear train 106 is configured to transmit the driving force from the development motor 11 to the three contact-separation members 104Y, 104M, and 104C. The fifth gear train 106 includes a plurality of gears, though a specific configuration thereof is not shown in FIG. 1 for the sake of explanatory simplicity. Each of the gears included in the fifth gear train 106 is coated with grease. The fifth gear train 106 is branched into three parts. The fifth gear train 106 includes a second electromagnetic clutch 107.

The second electromagnetic clutch 107 is positioned upstream of the three branched parts of the fifth gear train 106 in a direction in which the driving force from the development motor 11 is transmitted. The second electromagnetic clutch 107 is switchable between an ON state and an OFF state. When the second electromagnetic clutch 107 is in the ON state, the driving force from the development motor 11 is transmitted to the three contact-separation members 104Y, 104M, and 104C via the fifth gear train 106. When the second electromagnetic clutch 107 is in the OFF state, the driving force from the development motor 11 is shut off by the second electromagnetic clutch 107 and is not transmitted to any of the three contact-separation members 104Y, 104M, and 104C.

The first gear train 14 is configured to transmit the driving force from the development motor 11 to the four development rollers 71Y, 71M, 71C, and 71K. The first gear train 14 includes a plurality of gears, though a specific configuration thereof is not shown in FIG. 1 for the sake of explanatory simplicity. Each of the gears included in the first gear train 14 is coated with grease. The first gear train 14 is branched into four parts. The first gear train 14 includes four clutches 140Y, 140M, 140C, and 140K.

The clutch 140Y is included in a branched part to transmit the driving force to the development roller 71Y, among the four branched parts of the first gear train 14. The clutch 140Y is switchable between an ON state and an OFF state. When the clutch 140Y is in the ON state, the driving force from the development motor 11 is transmitted to the development roller 71Y. When the clutch 140Y is in the OFF state, the driving force from the development motor 11 is shut off by the clutch 140Y and is not transmitted to the development roller 71Y.

Each of the three clutches 140M, 140C, and 140K has substantially the same configuration as the clutch 140Y and therefore may be explained in the same manner as the clutch 140Y. The clutch 140M is included in a branched part to transmit the driving force to the development roller 71M, among the four branched parts of the first gear train 14. The clutch 140C is included in a branched part to transmit the driving force to the development roller 71C, among the four branched parts of the first gear train 14. The clutch 140K is included in a branched part to transmit the driving force to the development roller 71K, among the four branched parts of the first gear train 14.

The lever 141Y is configured to switch the state of the clutch 140Y between the ON state and the OFF state, in conjunction with movement of the contact-separation member 104Y. When the contact-separation member 104Y is in the first position, the lever 141Y puts the clutch 140Y into the ON state. Further, when the contact-separation member 104Y is in the second position (see FIG. 6), the lever 141Y puts the clutch 140Y into the OFF state.

Each of the three levers 141M, 141C, and 141K has substantially the same configuration as the lever 141Y and therefore may be explained in the same manner as the lever 141Y. Specifically, the lever 141M is configured to bring the clutch 140M into the ON state when the contact-separation member 104M is in the first position and to bring the clutch 140M into the OFF state when the contact-separation member 104M is in the second position (see FIG. 6). The lever 141C is configured to bring the clutch 140C into the ON state when the contact-separation member 104C is in the first position and to bring the clutch 140C into the OFF state when the contact-separation member 104C is in the second position (see FIG. 6). The lever 141K is configured to bring the clutch 140K into the ON state when the contact-separation member 104K is in the first position and to bring the clutch 140K into the OFF state when the contact-separation member 104K is in the second position (see FIG. 6).

The second gear train 15 is configured to transmit a driving force from the process motor 12 to the four photoconductive drums 4Y, 4M, 4C, and 4K, and the first roller 82. The second gear train 15 includes a plurality of gears, though a specific configuration thereof is not shown in FIG. 1 for the sake of explanatory simplicity. Each of the gears included in the second gear train 15 is coated with grease.

The third gear train 16 is configured to transmit a driving force from the fuser motor 13 to the heating roller 90. The third gear train 16 includes a plurality of gears, though a specific configuration thereof is not shown in FIG. 1 for the sake of explanatory simplicity. Each of the gears included in the third gear train 16 is coated with grease.

Figure 2:
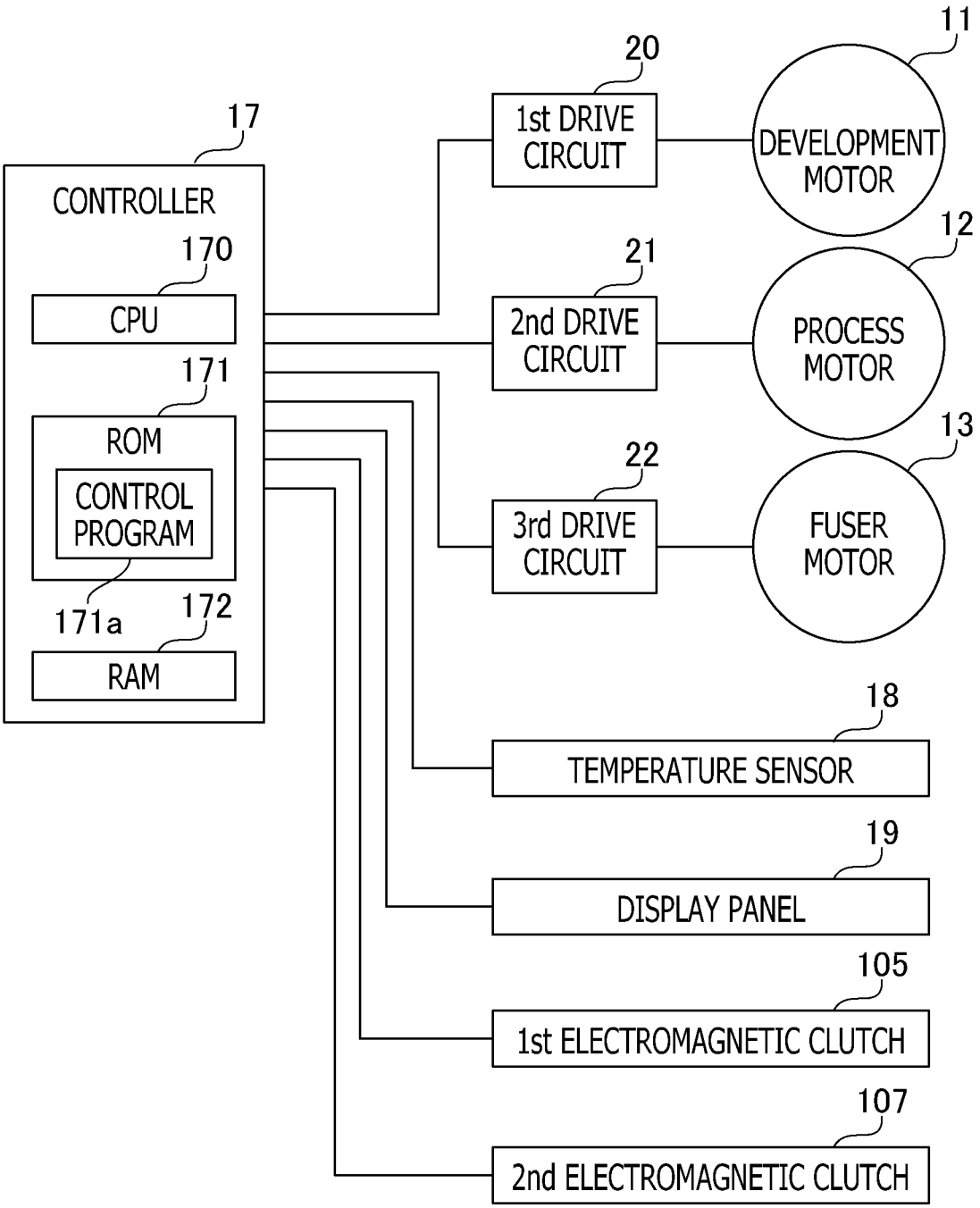
FIG. 2 is a block diagram schematically showing an electrical configuration of the image forming apparatus in the first illustrative embodiment according to one or more aspects of the present disclosure.

As shown in FIG. 2, the image forming apparatus 1 further includes a controller 17, a temperature sensor 18, a display panel 19, a first motor drive circuit 20, a second motor drive circuit 21, and a third motor drive circuit 22.

The controller 17 is configured to drive and control the development motor 11, the process motor 12, and the fuser motor 13. As will be described in detail later, printing speed modes executable by the controller 17 include a full-speed mode, a low-temperature mode, and a half-speed mode.

In the full-speed mode, the controller 17 controls the development motor 11 to rotate at a first target speed, controls the process motor 12 to rotate at a second target speed, and controls the fuser motor 13 to rotate at a fourth target speed. In the low-temperature mode, the controller 17 controls the development motor 11 to rotate at a third target speed lower than the first target speed, controls the process motor 12 to rotate at the second target speed that is the same as in the full-speed mode, and controls the fuser motor 13 to rotate at the fourth target speed that is the same as in the full-speed mode. In the half-speed mode, the controller 17 controls the development motor 11 to rotate at a fifth target speed that is half as high as the first target speed, controls the process motor 12 to rotate at a sixth target speed that is half as high as the second target speed, and controls the fuser motor 13 to rotate at a seventh target speed that is half as high as the fourth target speed.

Further, as will be described in detail later, printing color modes executable by the controller 17 include a four-color printing mode and a single-color printing mode.

In the four-color printing mode, the controller 17 controls the first electromagnetic clutch 105 and the second electromagnetic clutch 107 in such a manner that the image forming apparatus 1 performs printing by using toner (hereinafter, which may be referred to as "Y toner") stored in the development device 7Y, toner (hereinafter, which may be referred to as "M toner") stored in the development device 7M, toner (hereinafter, which may be referred to as "C toner") stored in the development device 7C, and toner (hereinafter, which may be referred to as "K toner") stored in the development device 7K. In the single-color printing mode, the controller 17 controls the first electromagnetic clutch 105 in such a manner that the image forming apparatus 1 performs printing by using only the K toner stored in the development device 7K.

The controller 17 is electrically connected with the temperature sensor 18, the display panel 19, the first electromagnetic clutch 105, the second electromagnetic clutch 107, the first motor drive circuit 20, the second motor drive circuit 21, and the third motor drive circuit 107. The controller 17 includes a CPU 170, a ROM 171, and a RAM 172. The ROM 171 stores a control program 171*a* for controlling operations of the image forming apparatus 1. The CPU 170 is configured to execute the control program 171*a* read out of the ROM 171. The RAM 172 is configured to temporarily store intermediate data generated during execution of the control program 171*a* by the CPU 170. Further, although the following configuration is not shown in any drawing, the controller 17 may include an interface connectable with an external device (e.g., a personal computer) other than the image forming apparatus 1.

The temperature sensor 18 is configured to measure a temperature inside the housing 2 and transmit the measured temperature inside the housing 2 to the controller 17. The temperature sensor 18 is disposed inside the housing 2.

The display panel 19 is disposed on a surface of the housing 2. The display panel 19 is configured to display an activation error of a motor in response to a signal from the controller 17.

The first motor drive circuit 20 is connected with the development roller 11. Thereby, the controller 17 is connected with the development roller 11 via the first motor drive circuit 20. The controller 17 inputs a first motor ON signal and a first clock into the first motor drive circuit 20. The first motor ON signal is for instructing the first motor drive circuit 20 to drive or stop the development motor 11. The first clock is for instructing the first motor drive circuit 20 what rotational speed the development motor 11 is to be driven at. While receiving the first motor ON signal, the first motor drive circuit 20 supplies the development motor 11 with a voltage to drive the development motor 11 at a target rotational speed corresponding to the first clock. When the rotational speed of the development motor 11 reaches the target rotational speed corresponding to the first clock, the first motor drive circuit 20 transmits a first motor lock signal to the controller 17.

The second motor drive circuit 21 is connected with the process motor 12. Thereby, the controller 17 is connected with the process motor 21 via the second motor drive circuit 21. The controller 17 inputs a second motor ON signal and a second clock into the second motor drive circuit 21. The second motor ON signal is for instructing the second motor drive circuit 21 to drive or stop the process motor 12. The second clock is for instructing the second motor drive circuit 21 what rotational speed the process motor 12 is to be driven at. While receiving the second motor ON signal, the second motor drive circuit 21 supplies the process motor 12 with a voltage to drive the process motor 12 at a target rotational speed corresponding to the second clock. When the rotational speed of the process motor 12 reaches the target rotational speed corresponding to the second clock, the second motor drive circuit 21 transmits a second motor lock signal to the controller 17.

The third motor drive circuit 22 is connected with the fuser motor 13. Thereby, the controller 17 is connected with the fuser motor 21 via the third motor drive circuit 22. The controller 17 inputs a third motor ON signal and a third clock into the third motor drive circuit 22. The third motor ON signal is for instructing the third motor drive circuit 22 to drive or stop the fuser motor 13. The third clock is for instructing the third motor drive circuit 22 what rotational speed the fuser motor 13 is to be driven at. While receiving the third motor ON signal, the third motor drive circuit 22 supplies the fuser motor 13 with a voltage to drive the fuser motor 13 at a target rotational speed corresponding to the third clock. When the rotational speed of the fuser motor 13 reaches the target rotational speed corresponding to the third clock, the third motor drive circuit 22 transmits a third motor lock signal to the controller 17.

3. Printing Process by Controller

Subsequently, a printing process by the controller 17 in the first illustrative embodiment will be described with reference to FIGS. 3 to 5.

Figure 3:
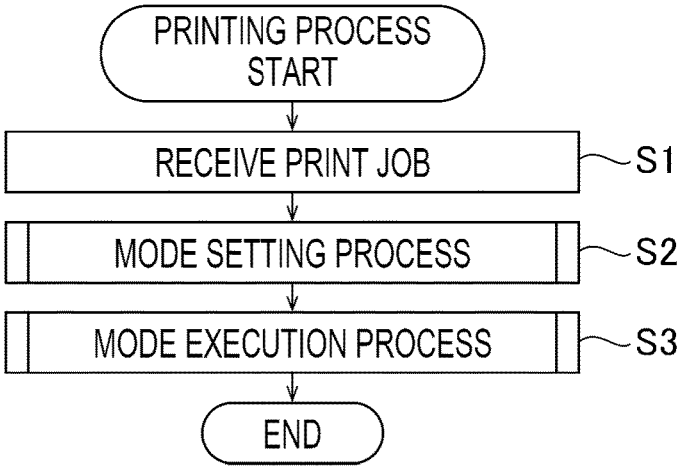
FIG. 3 is a flowchart showing a procedure of a printing process by a controller of the image forming apparatus in the first illustrative embodiment according to one or more aspects of the present disclosure.

As shown in FIG. 3, when receiving a print job (51), the controller 17 sequentially performs a mode setting process (S2) and a mode execution process (S3).

For instance, the print job may be input into the controller 17 from an external device connected with the controller 17. For instance, the print job may include information regarding the number of sheets to be printed, print color(s), and a sheet type. For instance, "four colors" or "single color" may be selected as the print color(s). For instance, selectable options as the sheet type may include "plain paper," "cardboard," "postcard," and "envelope."

3.1 Mode Setting Process

Figure 4:
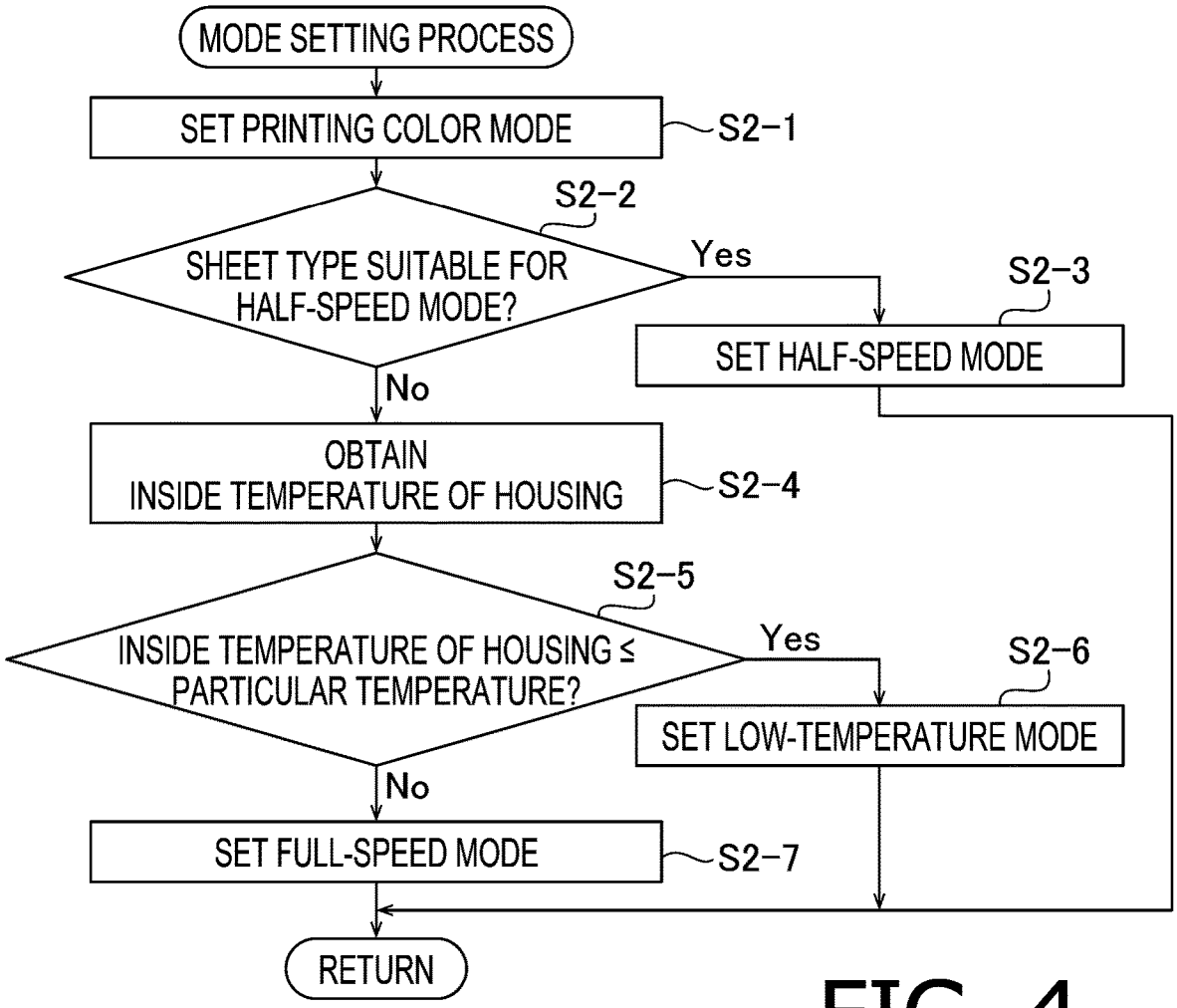
FIG. 4 is a flowchart showing a procedure of a mode setting process by the controller of the image forming apparatus in the first illustrative embodiment according to one or more aspects of the present disclosure.

As shown in FIG. 4, in the mode setting process, the controller 17 first sets a printing color mode based on the information regarding the print color(s) included in the print job (S2-1). When the print color(s) represented by the information included in the print job is "four colors," the controller 17 sets the four-color printing mode. When the print color(s) represented by the information included in the print job is "single color," the controller 17 sets the single-color printing mode.

Subsequently, the controller 17 determines whether the sheet type represented by the information included in the print job is suitable for the half-speed mode (S2-2). For instance, sheet types suitable for the half-speed mode may include, but are not limited to, "cardboard," "postcard," and "envelope," which have thermal capacities larger than a thermal capacity of "plain paper."

When determining that the sheet type represented by the information included in the print job is suitable for the half-speed mode (S2-2: Yes), the controller 17 sets the half-speed mode for the image forming apparatus 1 (S2-3). Meanwhile, when determining that the sheet type represented by the information included in the print job is not suitable for the half-speed mode (S2-2: No), the controller 17 obtains the temperature inside the housing 2 from the temperature sensor 18 (S2-4). Namely, the controller 17 obtains the inside temperature of the housing 2 from the temperature sensor 18, after receiving the print job and before beginning to drive the development motor 11.

Then, the controller 17 determines whether the inside temperature of the housing 2 is equal to or lower than a particular temperature (S2-5). The particular temperature may be previously set. For instance, the particular temperature may be within a range from 0° C. through 10° C. Preferably, the particular temperature may be 8° C.

When determining that the inside temperature of the housing 2 is equal to or lower than the particular temperature (S2-5: Yes), the controller 17 sets the low-temperature mode for the image forming apparatus 1 (S2-6). Meanwhile, when determining that the inside temperature of the housing 2 is higher than the particular temperature (S2-5: No), the controller 17 sets the full-speed mode for the image forming apparatus 1 (S2-7).

Thereby, the controller 17 determines the printing speed mode and terminates the mode setting process.

3.2 Mode Execution Process

Figure 5:
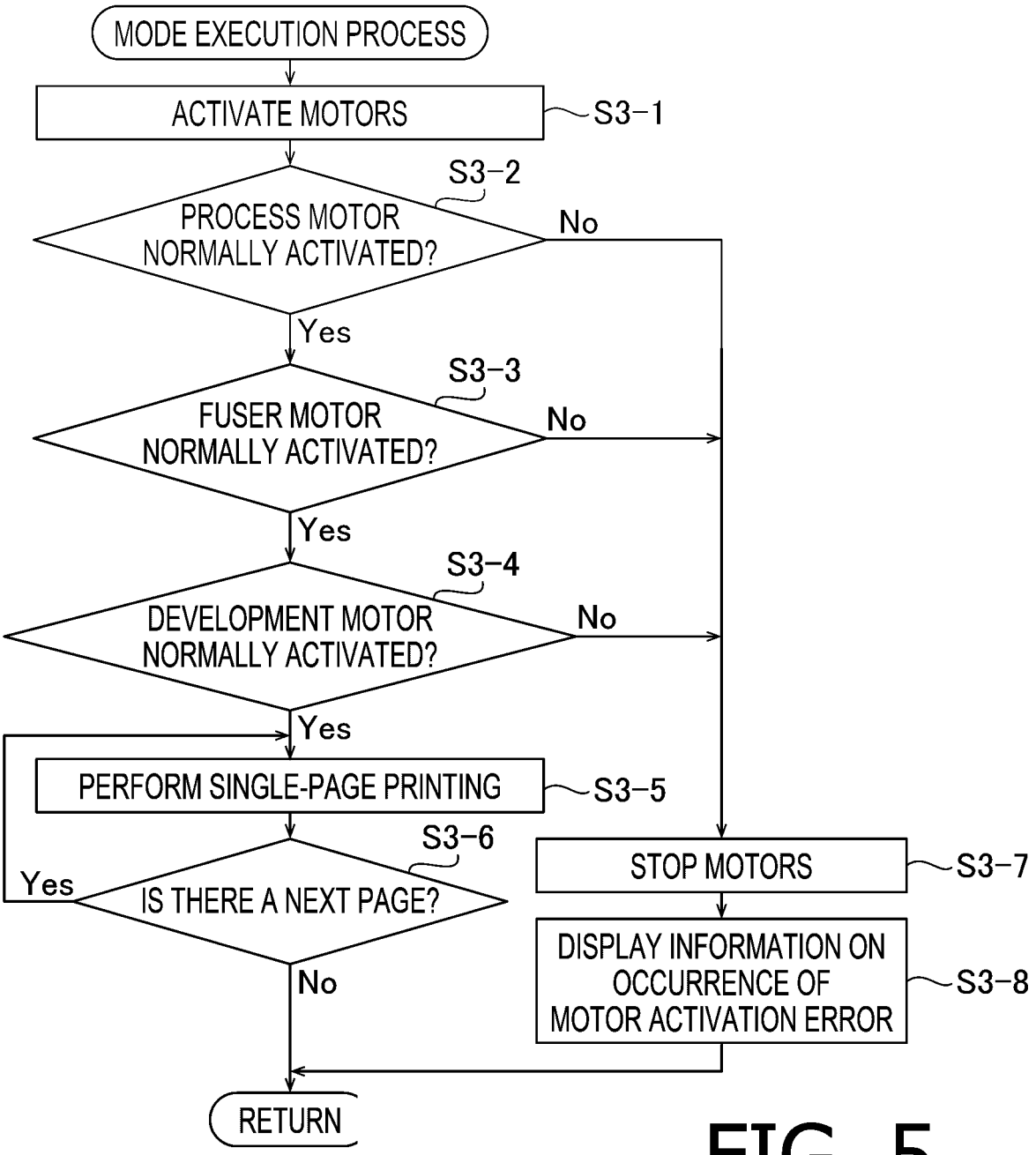
FIG. 5 is a flowchart showing a procedure of a mode execution process by the controller of the image forming apparatus in the first illustrative embodiment according to one or more aspects of the present disclosure.

Subsequently, as shown in FIG. 5, the controller 17 starts the mode execution process. In the mode execution process, the controller 17 executes the printing speed mode set in the mode setting process. For instance, when determining that the sheet type represented by the information included in the print job is suitable for the half-speed mode, the controller 17 executes the half-speed mode. Further, for instance, when determining that the sheet type represented by the information included in the print job is not suitable for the half-speed mode and that the inside temperature of the housing 2 is equal to or lower than the particular temperature, the controller 17 executes the low-temperature mode. Moreover, for instance, when determining that the sheet type represented by the information included in the print job is not suitable for the half-speed mode and that the inside temperature of the housing 2 is higher than the particular temperature, the controller 17 executes the full-speed mode.

Specifically, the controller 17 activates the development motor 11, the process motor 12, and the fuser motor 13 to execute the printing speed mode as set (S3-1).

The controller 17 inputs the first motor ON signal, and the first clock corresponding to the printing speed mode, into the first motor drive circuit 20. When the printing speed mode is the full-speed mode, the first clock corresponds to the first target speed of the development motor 11. When the printing speed mode is the low-temperature mode, the first clock corresponds to the third target speed lower than the first target speed. For instance, the third target speed may be within a range from 70% through 90% of the first target speed. Preferably, the third target speed may be 80% of the first target speed. When the printing speed mode is the half-speed mode, the first clock corresponds to the fifth target speed that is half as high as the first target speed.

Further, the controller 17 inputs the second motor ON signal, and the second clock corresponding to the printing speed mode, into the second motor drive circuit 21. When the printing speed mode is the full-speed mode or the low-temperature mode, the second clock corresponds to the second target speed of the process motor 12. When the printing speed mode is the half-speed mode, the second clock corresponds to the sixth target speed that is half as high as the second target speed.

Further, the controller 17 inputs the third motor ON signal, and the third clock corresponding to the printing speed mode, into the third motor drive circuit 21. When the printing speed mode is the full-speed mode or the low-temperature mode, the third clock corresponds to the fourth target speed of the fuser motor 13. When the printing speed mode is the half-speed mode, the third clock corresponds to the seventh target speed that is half as high as the fourth target speed.

Subsequently, the controller 17 determines whether the process motor 12 has been normally activated (S3-2), based on whether the controller 17 has received the second motor lock signal from the second motor drive circuit 21 within a predetermined period of time.

When determining that the process motor 12 has been normally activated (S3-2: Yes), the controller 17 determines whether the fuser motor 13 has been normally activated (S3-3), based on whether the controller 17 has received the third motor lock signal from the third motor drive circuit 22 within a particular period of time.

When determining that the fuser motor 13 has been normally activated (S3-3: Yes), the controller 17 determines whether the development motor 11 has been normally activated (S3-4), based on whether the controller 17 has received the first motor lock signal from the first motor drive circuit 20 within a prescribed period of time.

When determining that the development motor 11 has been normally activated (S3-4: Yes), the controller 17 performs printing of a first page in the print job (S3-5).

When determining that at least one of the process motor 12, the fuser motor 13, and the development motor 11 has not been normally activated (S3-2: No, S3-3: No, or S3-4: No), the controller 17 stops the development motor 11, the process motor 12, and the fuser motor 13 (S3-7). Then, the controller 17 controls the display panel 19 to display information representing that a motor activation error has occurred (S3-8).

Figure 6:
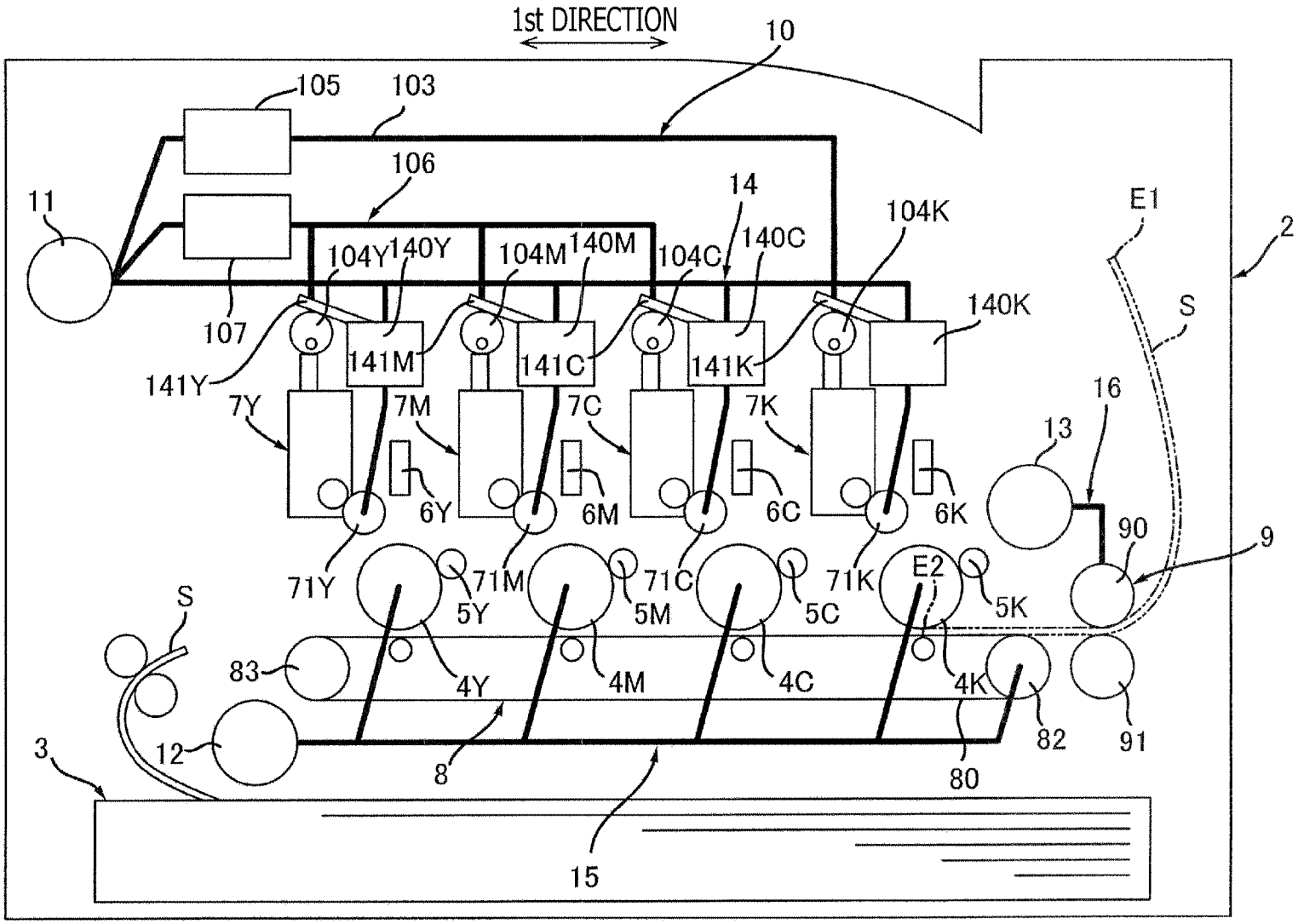
FIG. 6 shows a state where all of four development rollers are in respective separate positions, in the first illustrative embodiment according to one or more aspects of the present disclosure.

As shown in FIG. 6, during execution of the printing (S3-5), the controller 17 first controls the first electromagnetic clutch 105 and the second electromagnetic clutch 107 such that all the four development rollers 71Y, 71M, 71C, and 71K are placed in the respective separate positions.

Specifically, the controller 17 puts the first electromagnetic clutch 105 into the ON state. Then, the controller 17 takes control to transmit the driving force from the development motor 11 to the contact-separation member 104K and place the contact-separation member 104K in the second position. Thereby, the development roller 71K is placed in the separate position. Further, the lever 141K puts the clutch 140K into the OFF state. Thereby, the clutch 140K interrupts transmission of the driving force from the development motor 11. Afterward, the controller 17 puts the first electromagnetic clutch 105 into the OFF state.

Further, the controller 17 puts the second electromagnetic clutch 107 into the ON state. Then, the controller 17 takes control to transmit the driving force from the development motor 11 to the three contact-separation members 104Y, 104M, and 104C and place the three contact-separation members 104Y, 104M, and 104C in the respective second positions. Thereby, each of the three development rollers 71Y, 71M, and 71C is placed in the separate position. Further, the lever 141Y puts the clutch 140Y into the OFF state. The lever 141M puts the clutch 140M into the OFF state. The lever 141C puts the clutch 140C into the OFF state. Thereby, the three clutches 140Y, 140M, and 140C interrupt transmission of the driving force from the development motor 11. Afterward, the controller 17 puts the second electromagnetic clutch 107 into the OFF state.

Subsequently, the controller 17 controls the first electromagnetic clutch 105 and the second electromagnetic clutch 107 in accordance with the printing color mode. Thereby, each of the four development rollers 71Y, 71M, 71C, and 71K moves between the separate position and the contact position at particular timing.

3.2.1 Four-Color Printing Mode

Hereinafter, first, an explanation will be provided of a case where the printing color mode is the four-color printing mode. Thereafter, an explanation will be provided of a case where the printing color mode is the single-color printing mode.

Figure 7:
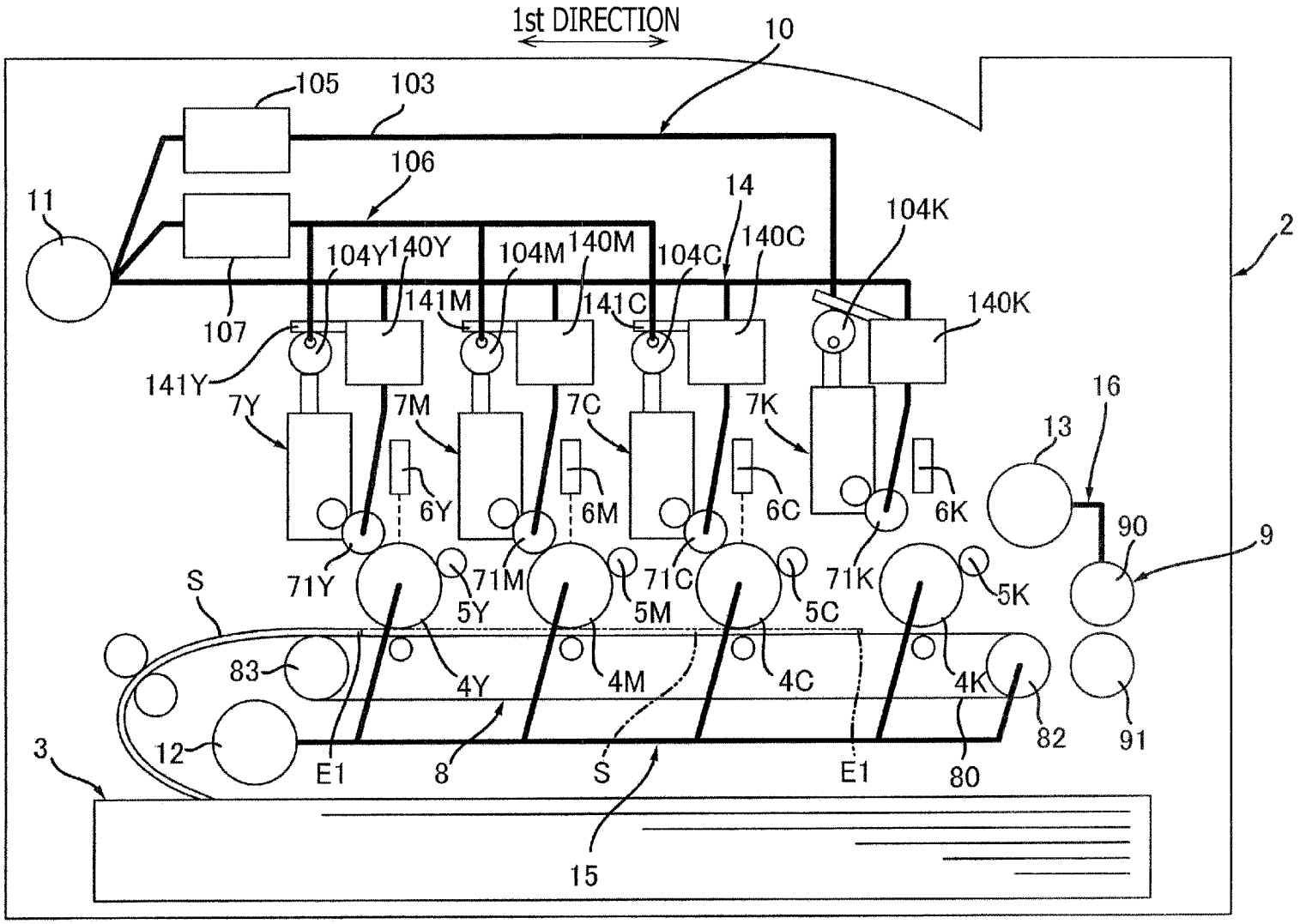
FIG. 7 shows a state where three development rollers are in respective contact positions, and the other development roller is in the separate position thereof, in the first illustrative embodiment according to one or more aspects of the present disclosure.

As shown in FIG. 7, the controller 17 puts the second electromagnetic clutch 107 into the ON state before a leading end E1 of the sheet S in a conveyance direction reaches a point between the photoconductive drum 4Y and the conveyance belt 80. Then, the controller 17 causes each of the three contact-separation members 104Y, 104M, and 104C to move from the second position to the first position. Thereby, each of the three development rollers 71Y, 71M, and 71C moves from the separate position to the contact position. Further, the lever 141Y puts the clutch 140Y into the ON state. The lever 141M puts the clutch 140M into the ON state. The lever 141C puts the clutch 140C into the ON state. Thereby, the driving force from the development motor 11 is transmitted to the three development rollers 71Y, 71M, and 71C. Afterward, the controller 17 puts the second electromagnetic clutch 107 into the OFF state.

Then, the sheet S is conveyed by the conveyance belt 80 and comes into contact with the three photoconductive drums 4Y, 4M, and 4C in sequence. Thereby, the toner image formed on the surface of the photoconductive drum 4Y, the toner image formed on the surface of the photoconductive drum 4M, and the toner image formed on the surface of the photoconductive drum 4C are sequentially transferred onto the sheet S.

Thereafter, as shown by an imaginary line in FIG. 7, the controller 17 puts the first electromagnetic clutch 105 into the ON state before the leading end E1 of the sheet S in the conveyance direction reaches a point between the photoconductive drum 4K and the conveyance belt 80. Then, the controller 17 controls the contact-separation member 104K to move from the second position to the first position. Thereby, the development roller 71K moves from the separate position to the contact position (see FIG. 1). Further, the lever 141K puts the clutch 140K into the ON state (see FIG. 1). Thus, the driving force from the development motor 11 is transmitted to the development roller 71K. After that, the controller 17 puts the first electromagnetic clutch 105 into the OFF state.

Then, the sheet S is conveyed by the conveyance belt 80 and comes into contact with the photoconductive drum 4K. Thereby, the toner image formed on the surface of the photoconductive drum 4K is transferred onto the sheet S (see FIG. 1).

Figure 8:
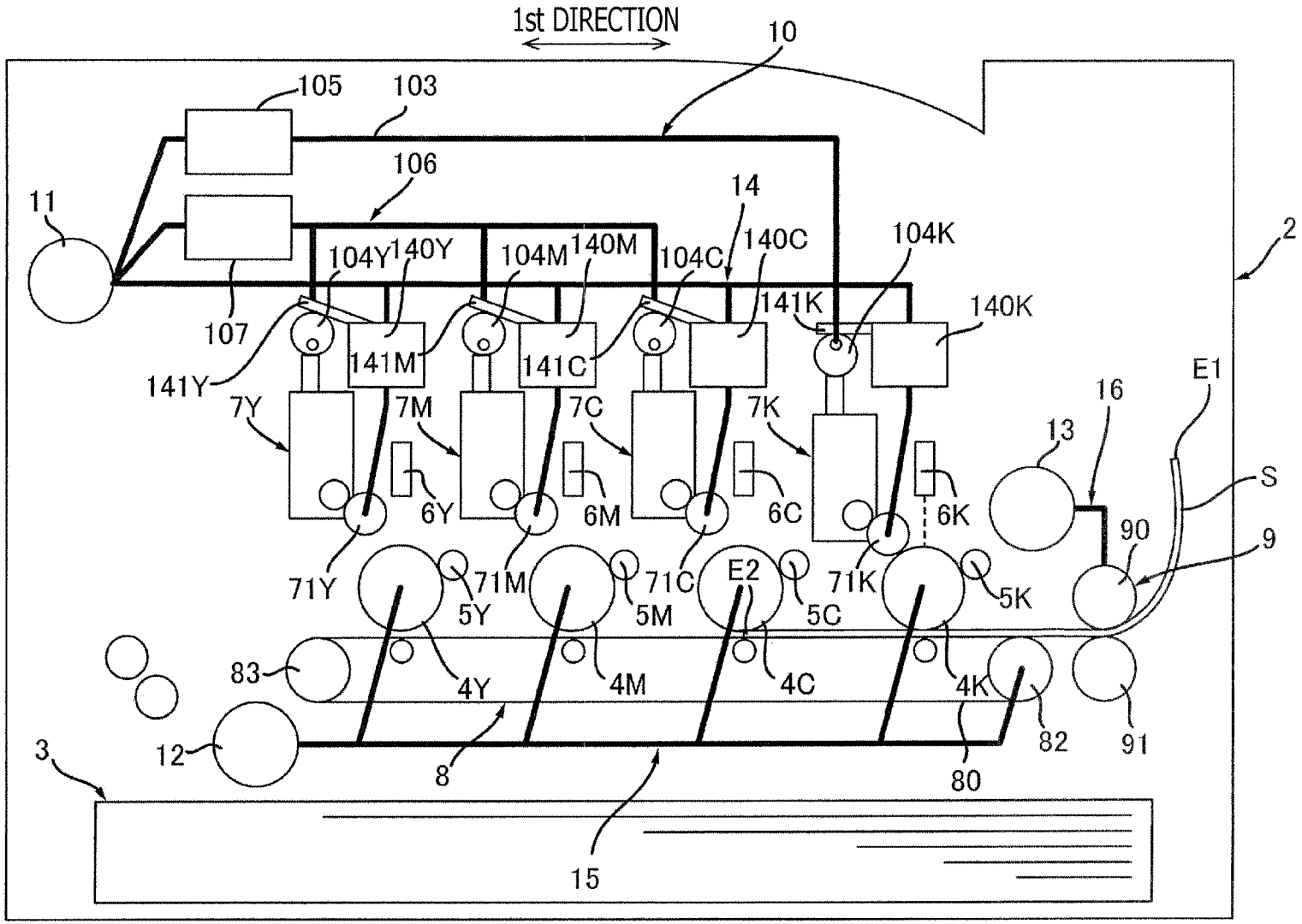
FIG. 8 shows a state where the three development rollers are in the respective separate positions, and the other development roller is in a contact position thereof, in the first illustrative embodiment according to one or more aspects of the present disclosure.

Subsequently, as shown in FIG. 8, the controller 17 puts the second electromagnetic clutch 107 into the ON state when a trailing end E2 of the sheet S in the conveyance direction passes between the photoconductive drum 4C and the conveyance belt 80. Then, the controller 17 controls each of the three contact-separation members 104Y, 104M, and 104C to move from the first position to the second position. Thereby, each of the three development rollers 71Y, 71M, and 71C moves from the contact position to the separate position. Further, the lever 141Y puts the clutch 140Y into the OFF state. The lever 141M puts the clutch 140M into the OFF state. The lever 141C puts the clutch 140C into the OFF state. Thus, the three clutches 140Y, 140M, and 140C interrupt transmission of the driving force from the development motor 11. After that, the controller 17 puts the second electromagnetic clutch 107 into the OFF state.

Subsequently, as shown by an imaginary line in FIG. 6, the controller 17 puts the first electromagnetic clutch 105 into the ON state when the trailing end E2 of the sheet S in the conveyance direction passes between the photoconductive drum 4K and the conveyance belt 80. Then, the controller 17 controls the contact-separation member 104K to move from the first position to the second position. Thereby, the development roller 71K moves from the contact position to the separate position. Further, the lever 141K puts the clutch 140K into the OFF state. Thereby, the clutch 140K interrupts transmission of the driving force from the development motor 11. Afterward, the controller 17 puts the first electromagnetic clutch 105 into the OFF state.

Thus, in the image forming apparatus 1, the four toner images having the respective four colors are transferred onto the first sheet S in the print job.

3.2.2 Single-Color Printing Mode

When the printing color mode is the single-color printing mode, as shown in FIG. 8, the controller 17 controls each of the three development rollers 71Y, 71M, and 71C to be held in the separate position. Then, the controller 17 controls the first electromagnetic clutch 105 such that the development roller 71K moves from the separate position to the contact position before the leading end E1 of the sheet S in the conveyance direction reaches the point between the photoconductive drum 4K and the conveyance belt 80.

Thereafter, the sheet S is conveyed by the conveyance belt 80 and comes into contact with the photoconductive drum 4K. Thereby, the toner image formed on the surface of the photoconductive drum 4K is transferred onto the sheet S. Afterward, as shown by the imaginary line in FIG. 6, the controller 17 controls the first electromagnetic clutch 105 such that the development roller 71K moves from the contact position to the separate position when the trailing end E2 of the sheet S in the conveyance direction passes between the photoconductive drum 4K and the conveyance belt 80.

Thus, in the image forming apparatus 1, the toner image of the single color is transferred onto the first sheet S in the print job.

After the single-page printing (S3-5) according to the printing color mode, as shown in FIG. 5, the controller 17 determines whether there is a next page in the print job (S3-6). When determining that there is a next page in the print job (S3-6: Yes), the controller 17 transfers a toner image onto the next page in the same manner as described above. Meanwhile, when determining that there is not a next page in the print job (S3-6: No), the controller 17 terminates the printing process. As described above, the controller 17 executes the print job.

Further, when receiving a subsequent print job (hereinafter referred to as a "second print job") after completing the previous print job (hereinafter referred to as the "first print job"), the controller 17 reperforms the mode setting process (S2) and the mode execution process (S3) in sequence (see FIG. 3). When determining that a sheet type represented by information included in the second print job is suitable for the half-speed mode (S2-2: Yes), the controller 17 executes the half-speed mode. Meanwhile, when determining that the sheet type represented by the information included in the second print job is not suitable for the half-speed mode (S2-2: No), the controller 17 obtains the inside temperature of the housing 2 from the temperature sensor 18 (S2-4), determines whether the inside temperature of the housing 2 is equal to or lower than the particular temperature (S2-5), and executes the full-speed mode or the low-temperature mode. Thus, the controller 17 executes the second print job.

In particular, when the first print job has been executed in the low-temperature mode, the inside temperature of the housing 2 may have risen through the printing process based on the first print job. Hence, when receiving the second print job, the controller 17 obtains the inside temperature of the housing 2 from the temperature sensor 18 (S2-4), determines whether the inside temperature of the housing 2 is equal to or lower than the particular temperature (S2-5), and executes the full-speed mode when determining that the inside temperature of the housing 2 is higher than the particular temperature (S2-5: No).

4. Operations and Advantageous Effects

In the image forming apparatus 1, as shown in FIG. 4, when determining that the inside temperature of the housing 2 is equal to or lower than the particular temperature, the controller 17 executes the low-temperature mode. In the low-temperature mode, the controller 17 controls the development motor 11 to rotate at the third target speed lower than the first target speed for the full-speed mode, and controls the process motor 12 to rotate at the second target speed that is the same as in the full-speed mode.

Therefore, in the low-temperature mode, the image forming apparatus 1 may rotate the development motor 11 at the rotational speed lower than the rotational speed for the full-speed mode, and may maintain the rotational speed of each of the four photoconductive drums 4Y, 4M, 4C, and 4K and a moving velocity of the conveyance belt 80 to be the same as those for the full-speed mode. Thus, in the low-temperature mode, the image forming apparatus 1 may maintain a conveyance velocity for conveying the sheet S to be the same as that for the full-speed mode. Consequently, it is possible to ensure an adequate torque of the development motor 11 and suppress reduction in printing speed when the inside temperature of the housing 2 is equal to or lower than the particular temperature.

The controller 17 controls the fuser motor 13 to rotate at the fourth target speed in both the full-speed mode and the low-temperature mode. Therefore, it is possible to certainly suppress reduction in printing speed in the low-temperature mode.

The controller 17 may execute the half-speed mode. Therefore, the image forming apparatus 1 is allowed to stably perform printing on a sheet S having a thermal capacity larger than the thermal capacity of "plain paper."

Second Illustrative Embodiment

Figure 9:
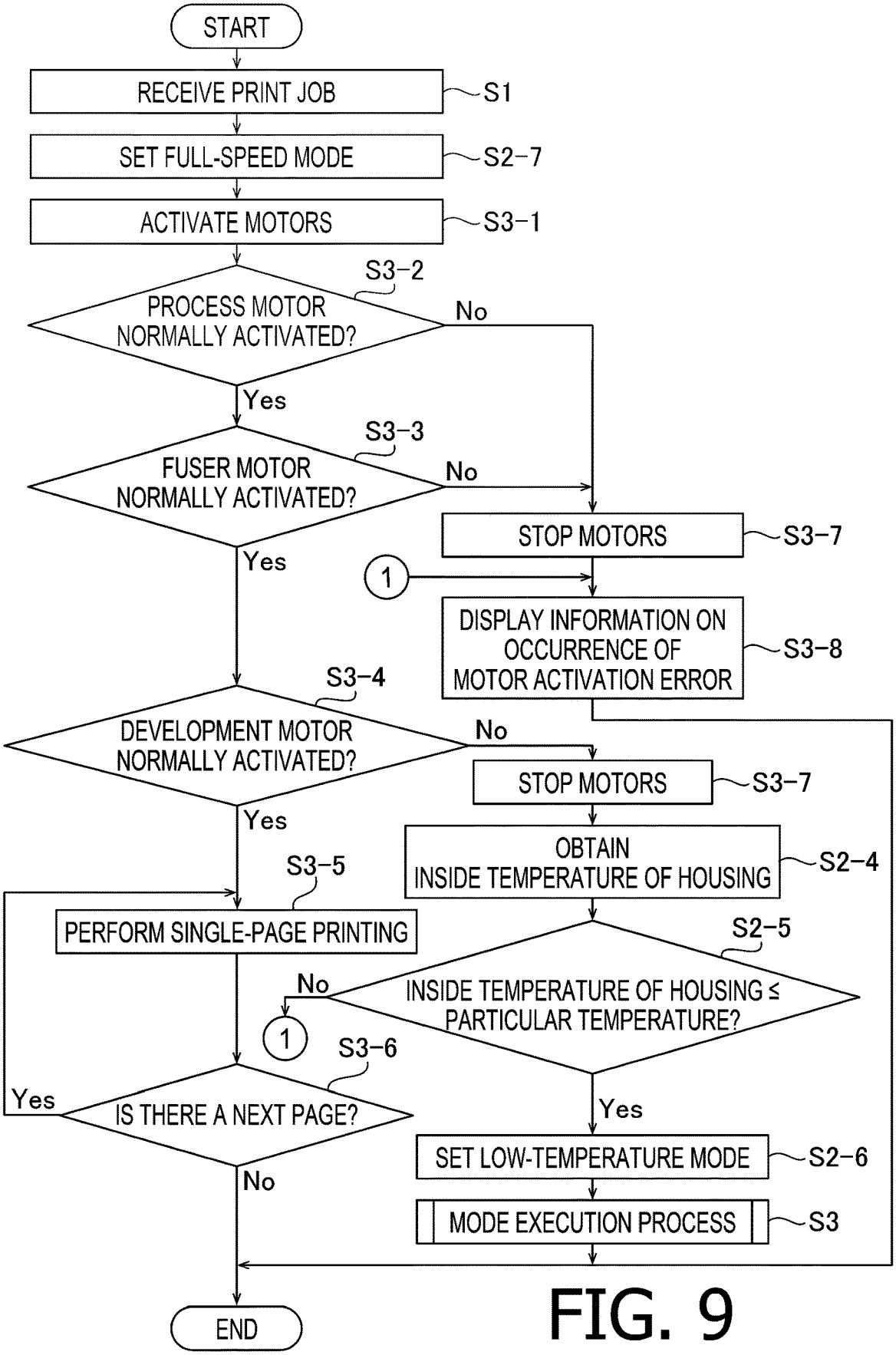
FIG. 9 is a flowchart showing a procedure of a printing process by a controller of an image forming apparatus in a second illustrative embodiment according to one or more aspects of the present disclosure.

Subsequently, referring to FIG. 9, an explanation will be provided of a printing process by the controller 17 in a second illustrative embodiment according to aspects of the present disclosure. In the second illustrative embodiment, substantially the same steps as exemplified in the aforementioned first illustrative embodiment will be provided with the same reference characters, and explanations thereof will be omitted.

When receiving a print job (51), the controller 17 sets the full-speed mode for the image forming apparatus 1 (S2-7).

Subsequently, the controller 17 executes the full-speed mode before obtaining the inside temperature of the housing 2 from the temperature sensor 18. Specifically, the controller 17 activates the development motor 11, the process motor 12, and the fuser motor 13 to execute the full-speed mode (S3-1).

Afterward, the controller 17 determines whether the process motor 12 has been normally activated (S3-2). When determining that the process motor 12 has been normally activated (S3-2: Yes), the controller 17 determines whether the fuser motor 13 has been normally activated (S3-3).

When determining that the fuser motor 13 has been normally activated (S3-3: Yes), the controller 17 determines whether the development motor 11 has been normally activated (S3-4). In other words, in S3-4, the controller 17 determines whether the development motor is rotating at the first target speed.

When determining that the development motor is rotating at the first target speed (S3-4: Yes), the controller 17 performs printing of a first page in the print job (S3-5).

Thereafter, the controller 17 determines whether there is a next page in the print job (S3-6). When determining that there is a next page in the print job (S3-6: Yes), the controller 17 transfers a toner image onto the next page. Meanwhile, when determining that there is not a next page in the print job (S3-6: No), the controller 17 terminates the printing process.

Further, when determining that the development motor is not rotating at the first target speed (S3-4: No), the controller 17 stops the development motor 11, the process motor 12, and the fuser motor 13, and terminates the full-speed mode (S3-7).

Then, the controller 17 obtains the inside temperature of the housing 2 from the temperature sensor 18 (S2-4), and determines whether the inside temperature of the housing 2 is equal to or lower than the particular temperature (S2-5).

When determining that the inside temperature of the housing 2 is equal to or lower than the particular temperature (S2-5: Yes), the controller 17 sets the low-temperature mode for the image forming apparatus 1 (S2-6). After that, the controller 17 starts the mode execution process (S3). Thus, the controller 17 executes the low-temperature mode when determining that the inside temperature of the housing 2 is equal to or lower than the particular temperature.

Meanwhile, when determining that the inside temperature of the housing 2 is higher than the particular temperature (S2-5: No), the controller 17 controls the display panel 19 to display information representing that a motor activation error has occurred (S3-8). Further, when determining that at least one of the process motor 12 and the fuser motor 13 has not been normally activated (S3-2: No, or S3-3: No), the controller 17 stops the development motor 11 and the process motor 12 (S3-7). Then, the controller 17 controls the display panel 19 to display information representing that a motor activation error has occurred (S3-8).

Thus, the image forming apparatus 1 of the second illustrative embodiment may provide substantially the same operations and advantageous effects as presented in the aforementioned first illustrative embodiment.

Hereinabove, the illustrative embodiments according to aspects of the present disclosure have been described. Aspects of the present disclosure may be practiced by employing conventional materials, methodology and equipment. Accordingly, such materials, equipment and methodology are not set forth herein in detail. In the previous descriptions, numerous specific details are set forth, such as specific materials, structures, processes, etc., in order to provide a thorough understanding of the present disclosure. However, it should be recognized that aspects of the present disclosure may be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that aspects of the present disclosure are capable of use in various other combinations and environments and are capable of changes or modifications within the scope of the inventive concept as expressed herein. For instance, the following modifications according to aspects of the present disclosure are feasible.

Modifications

In the aforementioned first illustrative embodiment, the printing speed modes executable by the controller 17 include the half-speed mode. Nonetheless, only the low-temperature mode and the full-speed mode may be included in the printing speed modes executable by the controller 17. In this case, in the mode setting process shown in FIG. 4, the controller 17 may obtain the inside temperature of the housing 2 from the temperature sensor 18 (S2-4) after setting the printing color mode (S2-1). The image forming apparatus 1 of this modification may provide substantially the same operations and advantageous effects as presented in the aforementioned first illustrative embodiment.

What is claimed is:

1. An image forming apparatus comprising:

a housing;

a photoconductive drum;

a development roller movable between a contact position where the development roller contacts the photoconductive drum and a separate position where the development roller is separated from the photoconductive drum, the development roller being configured to supply toner to the photoconductive drum in the contact position;

a switching mechanism configured to move the development roller between the contact position and the separate position;

a conveyance belt configured to convey a sheet in a state where the sheet is nipped between the conveyance belt and the photoconductive drum;

a development motor configured to drive the development roller and the switching mechanism;

a process motor configured to drive the photoconductive drum and the conveyance belt;

a temperature sensor configured to measure a temperature inside the housing; and a controller comprising:

a processor; and a memory storing processor-executable instructions configured to, when executed by the processor, cause the controller to:

before driving the development motor, obtain the temperature inside the housing from the temperature sensor;

determine whether the obtained temperature inside the housing is equal to or lower than a particular temperature;

when determining that the obtained temperature inside the housing is higher than the particular temperature, execute a full-speed mode to control the development motor to rotate at a first target speed and control the process motor to rotate at a second target speed; and when determining that the obtained temperature inside the housing is equal to or lower than the particular temperature, execute a low-temperature mode to control the development motor to rotate at a third target speed lower than the first target speed and control the process motor to rotate at the second target speed that is the same as in the full-speed mode.

2. The image forming apparatus according to claim 1, further comprising:

a fuser configured to fix a toner image onto the sheet; and a fuser motor configured to drive the fuser, wherein the controller is further configured to:

when determining that the obtained temperature inside the housing is higher than the particular temperature, execute the full-speed mode to control the fuser motor to rotate at a fourth target speed; and when determining that the obtained temperature inside the housing is equal to or lower than the particular temperature, execute the low-temperature mode to control the fuser mode to rotate at the fourth target speed that is the same as in the full-speed mode.

3. The image forming apparatus according to claim 2, wherein the controller is further configured to execute a half-speed mode to control the development motor to rotate at a fifth target speed that is half as high as the first target speed, control the process motor to rotate at a sixth target speed that is half as high as the second target speed, and control the fuser motor to rotate at a seventh target speed that is half as high as the fourth target speed.

4. The image forming apparatus according to claim 1, wherein the third target speed is within a range from 70% through 90% of the first target speed.

5. The image forming apparatus according to claim 4, wherein the third target speed is 80% of the first target speed.

6. The image forming apparatus according to claim 1, wherein the particular temperature is within a range from 0° C. through 10° C.

7. The image forming apparatus according to claim 6, wherein the particular temperature is 8° C.

8. The image forming apparatus according to claim 1, wherein the controller is further configured to:

after receiving a first print job, obtain a first temperature inside the housing from the temperature sensor;

determine whether the obtained first temperature inside the housing is equal to or lower than the particular temperature;

execute the first print job in one of the full-speed mode and the low-temperature mode depending on whether the obtained first temperature inside the housing is equal to or lower than the particular temperature;

when receiving a second print job after completing the first print job, obtain a second temperature inside the housing from the temperature sensor;

determine whether the obtained second temperature inside the housing is equal to or lower than the particular temperature; and execute the second print job in one of the full-speed mode and the low-temperature mode depending on whether the obtained second temperature inside the housing is equal to or lower than the particular temperature.

9. An image forming apparatus comprising:

a housing;

a photoconductive drum;

a development roller movable between a contact position where the development roller contacts the photoconductive drum and a separate position where the development roller is separated from the photoconductive drum, the development roller being configured to supply toner to the photoconductive drum in the contact position;

a switching mechanism configured to move the development roller between the contact position and the separate position;

a conveyance belt configured to convey a sheet in a state where the sheet is nipped between the conveyance belt and the photoconductive drum;

a development motor configured to drive the development roller and the switching mechanism;

a process motor configured to drive the photoconductive drum and the conveyance belt;

a temperature sensor configured to measure a temperature inside the housing; and a controller comprising:

a processor; and a memory storing processor-executable instructions configured to, when executed by the processor, cause the controller to:

before obtaining the temperature inside the housing from the temperature sensor, execute a full-speed mode to control the development motor to rotate at a first target speed and control the process motor to rotate at a second target speed;

determine whether the development motor is rotating at the first target speed;

when determining that the development motor is not rotating at the first target speed, terminate the full-speed mode and obtain the temperature inside the housing from the temperature sensor; and when determining that the obtained temperature inside the housing is equal to or lower than a particular temperature, execute a low-temperature mode to control the development motor to rotate at a third target speed lower than the first target speed and control the process motor to rotate at the second target speed that is the same as in the full-speed mode.

10. An image forming apparatus comprising:

a housing;

a photoconductive drum;

a development roller;

a development motor configured to drive the development roller;

a process motor configured to drive the photoconductive drum;

a temperature sensor configured to measure a temperature inside the housing; and a controller comprising:

a processor; and a memory storing processor-executable instructions configured to, when executed by the processor, cause the controller to:

before driving the development motor, obtain the temperature inside the housing from the temperature sensor;

determine whether the obtained temperature inside the housing is equal to or lower than a particular temperature;

when determining that the obtained temperature inside the housing is higher than the particular temperature, execute a full-speed mode to control the development motor to rotate at a first target speed and control the process motor to rotate at a second target speed; and when determining that the obtained temperature inside the housing is equal to or lower than the particular temperature, execute a low-temperature mode to control the development motor to rotate at a third target speed lower than the first target speed and control the process motor to rotate at the second target speed that is the same as in the full-speed mode.

11. The image forming apparatus according to claim 10, further comprising:

a fuser configured to fix a toner image onto the sheet; and a fuser motor configured to drive the fuser, wherein the controller is further configured to:

when determining that the obtained temperature inside the housing is higher than the particular temperature, execute the full-speed mode to control the fuser motor to rotate at a fourth target speed; and when determining that the obtained temperature inside the housing is equal to or lower than the particular temperature, execute the low-temperature mode to control the fuser mode to rotate at the fourth target speed that is the same as in the full-speed mode.

12. The image forming apparatus according to claim 11, wherein the controller is further configured to execute a half-speed mode to control the development motor to rotate at a fifth target speed that is half as high as the first target speed, control the process motor to rotate at a sixth target speed that is half as high as the second target speed, and control the fuser motor to rotate at a seventh target speed that is half as high as the fourth target speed.

13. The image forming apparatus according to claim 10, wherein the third target speed is within a range from 70% through 90% of the first target speed.

14. The image forming apparatus according to claim 13, wherein the third target speed is 80% of the first target speed.

15. The image forming apparatus according to claim 10, wherein the particular temperature is within a range from 0° C. through 10° C.

16. The image forming apparatus according to claim 15, wherein the particular temperature is 8° C.

17. The image forming apparatus according to claim 10, wherein the controller is further configured to:

after receiving a first print job, obtain a first temperature inside the housing from the temperature sensor;

determine whether the obtained first temperature inside the housing is equal to or lower than the particular temperature;

execute the first print job in one of the full-speed mode and the low-temperature mode depending on whether the obtained first temperature inside the housing is equal to or lower than the particular temperature;

when receiving a second print job after completing the first print job, obtain a second temperature inside the housing from the temperature sensor;

determine whether the obtained second temperature inside the housing is equal to or lower than the particular temperature; and execute the second print job in one of the full-speed mode and the low-temperature mode depending on whether the obtained second temperature inside the housing is equal to or lower than the particular temperature.

* * * * *